United States Patent [19]

Ishizuka et al.

[11] 4,242,065

[45] Dec. 30, 1980

[54] SLIDING VANE COMPRESSOR WITH END FACE INSERTS OR ROTOR

[75] Inventors: Yutaka Ishizuka, Higashimatsuyama; Shinichi Kobayashi, Kawagoe, both of Japan

[73] Assignee: Robert Bosch GmbH, Stuttgart, Fed. Rep. of Germany

[21] Appl. No.: 961,147

[22] Filed: Nov. 15, 1978

[30] Foreign Application Priority Data

Nov. 19, 1977 [JP] Japan ..... 52/155917[U]

[51] Int. Cl.[3] ..... F04C 29/00; F04C 29/02

[52] U.S. Cl. ..... 418/91; 418/178; 418/179; 418/270

[58] Field of Search ..... 418/83, 91, 178, 179, 418/270; 92/155

[56] References Cited

U.S. PATENT DOCUMENTS

| | | | |
|---|---|---|---|
| 3,193,052 | 7/1965 | Baumler et al. | 418/83 |
| 3,374,943 | 3/1968 | Cervenka | 418/179 |
| 3,545,901 | 12/1970 | Belzner | 418/179 |
| 3,632,240 | 1/1972 | Dworak | 418/179 |
| 3,913,706 | 10/1975 | Ernest et al. | 418/91 |
| 4,059,370 | 11/1977 | Gibson | 418/91 |

FOREIGN PATENT DOCUMENTS

| | | | |
|---|---|---|---|
| 471989 | 2/1929 | Fed. Rep. of Germany | 418/270 |
| 1189786 | 3/1965 | Fed. Rep. of Germany | 418/91 |

*Primary Examiner*—John J. Vrablik
*Attorney, Agent, or Firm*—Michael J. Striker

[57] ABSTRACT

A sliding vane compressor has a housing and a rotor mounted in the housing. The rotor has axial endfaces which are juxtaposed with respective housing surfaces from which they must be kept at a predetermined spacing. This spacing is obtained by mounting in open recesses of the axial rotor endfaces respective elements of a material having a higher coefficient of thermal expansion than the material of the rotor itself. As the compressor comes up to operating temperatures the resulting thermal expansion of these elements causes them to protrude beyond the axial rotor endfaces by a distance corresponding to the desired spacing.

10 Claims, 5 Drawing Figures

SLIDING VANE COMPRESSOR WITH END FACE INSERTS OR ROTOR

BACKGROUND OF THE INVENTION

1. Field of the Invention

The present invention relates to compressors.

More particularly, the invention relates to sliding vane compressors.

2. The Prior Art

One of the problems which are encountered with prior-art sliding vane compressors is how to maintain the required amount of play (i.e., spacing) between the axial endfaces of the rotor and the juxtaposed surfaces of the chamber in which the same is mounted. This spacing, between each axial rotor endface and the juxtaposed chamber surface, is generally about 0.05 mm; it is set and maintained by means of axial pressure bearings. These are mounted on the rotary shaft of the compressor and support the rotor against the housing walls having the aforementioned chamber surfaces. Such bearings, e.g., needle bearings or roller bearings, must be high-precision bearings which are correspondingly expensive. Also, the juxtaposed surfaces of the housing and the rotor must be precision machined to make them as planar as possible, and all elements must be assembled with the greatest care to assure their proper cooperation. All of these factors combine to make the prior-art compressors of the type in question rather expensive.

SUMMARY OF THE INVENTION

It is an object of the invention to provide an improved sliding vane compressor which is not subject to the prior-art disadvantages.

Another object is to provide such a compressor wherein the spacing necessary between the rotor endfaces and the juxtaposed chamber surfaces will set and maintain itself as a function of the operation of the compressor.

Still a further object is to provide a compressor of the type in question which is much simpler and less expensive to construct than those of the prior art.

Pursuant to the above objects, and still others which will become apparent hereafter, one aspect of the invention resides in a sliding vane compressor of the type having a housing and a rotor journalled for rotation in a chamber of the housing so that the axial endfaces of the rotor are juxtaposed with slight clearance relative to cooperating housing surfaces. In such a compressor, the invention provides means bounding a plurality of recesses in each axial endface of the rotor; and an insert received in each of the recesses and being of a material having a relatively low coefficient of friction and having a coefficient of thermal expansion which is higher than that of the material of the rotor so that, upon reaching a predetermined temperature, the inserts expand and extend across the respective clearance into contact with the housing surfaces to prevent direct contact between the same and the axial endfaces of the rotor.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 1:
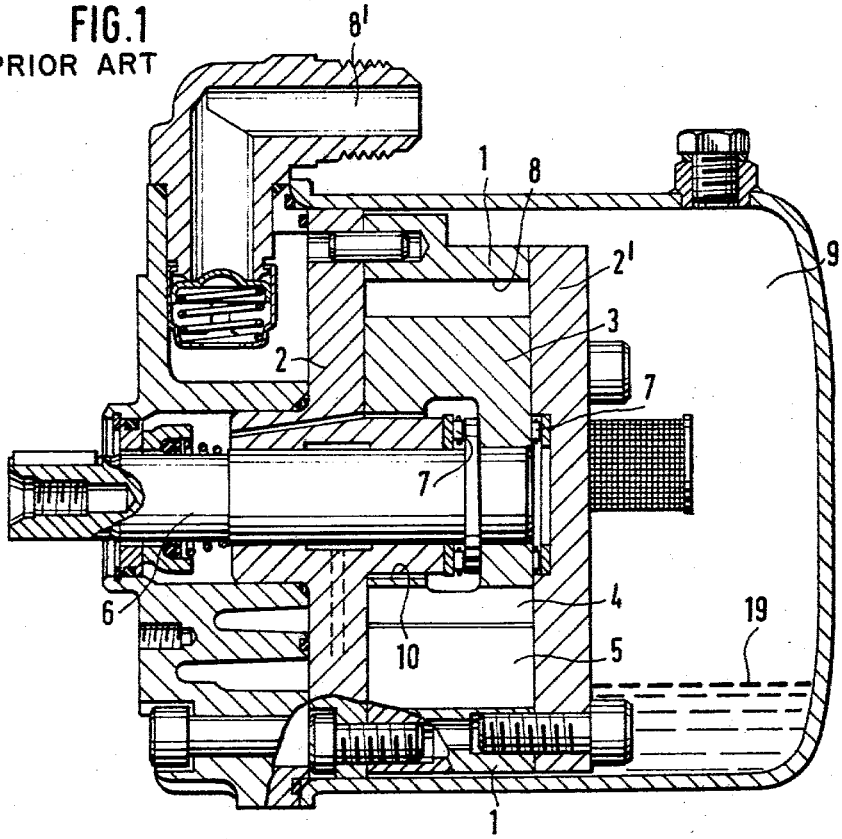
FIG.1 PRIOR ART
FIG. 1 is an axial section through a compressor according to the prior art.

A conventional sliding vane compressor, i.e., a compressor according to the prior art, is illustrated in FIG. 1. It has a housing which is essentially composed of a center section 1, a left endsection or cover 2 and a right endsection or cover 2'. The covers 2, 2' are screw-threaded into the open ends of the annular center section 1.

The center section 1 is formed with a chamber 8 of cylindrical outline which is circumferentially bounded by an inner surface of the section 1; the axial ends of the chamber 8 are closed by the inwardly directed surfaces of the covers 2, 2'. The inner circumferential surface of the section 1 may be elliptical or circular (in the latter case it is non-coaxial with chamber 8) and forms the cam track which dictates movement of the sliding vanes during operation of the compressor 3 mounted in the chamber 8. The outer circumferential surface of rotor 3 is cylindrical and defines with the inner circumferential surface of the section 8 two fluid compartments of approximately sickel-shaped configuration.

The rotor 3 has a central bore 10 in which an end portion of a rotary shaft 6 is press-fitted. The shaft is journalled for rotation in two sleeve bearings which, in turn, are mounted in a tubular part of the left-hand cover 2, as shown.

There are also provided axial needle bearings 7 which are arranged coaxially with the shaft 6 and serve to support the rotor 3 in axial direction. It is these bearings 7 which determine the amount of play (i.e., the spacing) between the axial endfaces of the rotor 3 and the therewith juxtaposed planar inner surfaces of the covers 2, 2'. This spacing amounts at each axial end of the rotor to about 0.05 mm and must be set extremely precisely. It will be appreciated that if the spacing is too small it will permit contact between the rotor and the respective cover with the resulting frictional losses, whereas, if the spacing is too great, leakage losses will develop in the compressor.

The rotor 3 is provided with several radial slots 4 in which the respective vanes 5 are tightly but slidably received and guided. The radially outer edges of the sliding vanes 5 are in sliding engagement with the inner circumferential surface of the section 1 so as to subdivide the afore-mentioned fluid compartments into individual cells. Each of the fluid compartments has a suction (low-pressure) region and a high-pressure region. The suction region communicates with a fluid inlet 8' whereas the high-pressure region of each fluid compartment communicates (via not illustrated valves) with the interior 9 of a cupped outer housing which surrounds and is connected to the inner housing 1, 2, 2'. It is this interior 9 which constitutes the pressure chamber of the compressor; in operation it contains an oilsump 19 in its lower region.

The compressor according to the present invention corresponds in most aspects to the prior-art compressor shown in FIG. 1. In fact, it differs from the same only in the details shown and explained with reference to the embodiments of FIGS. 2–4 and 5, respectively. Therefore, a repeated illustration of the entire compressor is not considered to be necessary.

Figure 2:
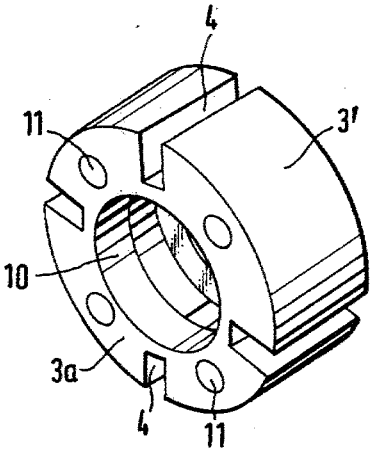
FIG. 2 is a perspective view, illustrating a detail of a rotor according to one embodiment of the invention.
Figure 3:
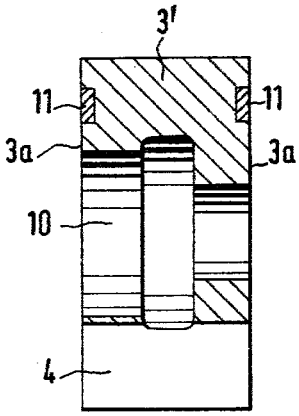
FIG. 3 is an axial section through the rotor in FIG. 1.
Figure 4:
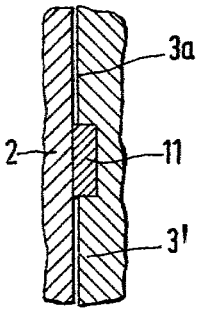
FIG. 4 is a diagrammatic sectional view, showing the operation of the invention in connection with the rotor of FIGS. 2 and 3.

According to a first embodiment of the invention, illustrated in FIGS. 2–4, the rotor 3' has a center bore 10 (corresponding to the one of the rotor 3 in FIG. 1) in which the shaft 6 (FIG. 1) is to be mounted. Unlike the prior art, however, the rotor 3' is provided in its axial endfaces with circumferentially distributed recesses (e.g., blind bores) in each of which a plate or otherwise shaped member 11 is mounted (e.g., adhesively, by press-fitting or in another suitable manner). The plates 11 are of a material having a relatively low coefficient of friction and a coefficient of thermal expansion which is greater than that of the rotor material (usually steel). A suitable material for the plates is aluminum, although other materials suitable for this purpose will be readily apparent to those skilled in the art.

At room temperature the outer exposed surfaces of the plates 11 are flush with the respective axial endface 3*a* of the rotor 3' (see FIG. 3). However, when the rotor 3' (installed in the compressor of FIG. 1) reaches the operating temperature of the compressor, then the plates 11 expand and project outwardly from the axial endfaces 3*a*, due to the fact that the coefficient of thermal expansion of the plates 11 is greater than that of the rotor 3'. The projecting plates 11 then contact the inner surfaces of the covers 2, 2' (as shown for cover 2 in FIG. 4) and thus space the axial endfaces 3*a* from the covers 2, 2'. In other words: as the rotor 3' reaches operating temperature the necessary spacing between the covers 2, 2' and the axial endfaces 3*a* is automatically established and it is maintained until the temperature of rotor 3' drops again below operating temperature (i.e., the compressor is shut down). The extent of such projection may be up to about 0.1 mm in all embodiments, but about 0.002 to 0.003 mm has been found particularly advantageous.

It will be clear that during start-up of the compressor respective endfaces 3*a* will be in contact with the covers 2, 2'. However, the heat produced by this frictional contact will quickly cause the plates 11 to expand and establish the desired spacing (FIG. 4) so that the start-up phase with its friction losses will only be of brief duration.

Evidently, a compressor (similar to the one in FIG. 1) using the rotor 3' of FIGS. 2–4 does not require the bearings 7 shown in FIG. 1, so that these may be omitted. In some special cases it may be desirable to retain such bearings; however, even then the invention will proffer its benefits because due to the presence of the rotor 3' it is possible under such circumstances to use bearings which are manufactured to much less exacting tolerances (and hence less expensive) and also to assemble the compressor to less exacting tolerance specifications.

Figure 5:
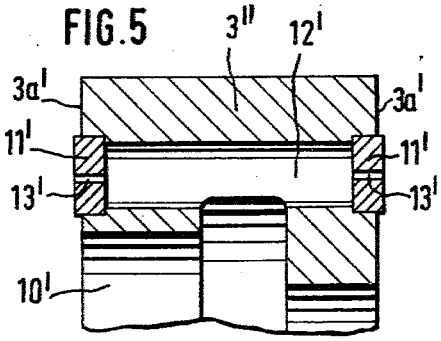
FIG. 5 is a fragmentary axial section through another embodiment of the invention.

Another embodiment of the invention is illustrated in FIG. 5. The rotor 3'' as shown there is again suitable for use in a compressor of the type and construction shown in FIG. 1. It has a center bore 10' for the shaft 6 (not shown).

In the embodiment of FIG. 5 the weight of the rotor 3'' is reduced by forming the same with axially throughgoing hollows 12' (e.g., bores or the like) in the axial ends of which the plates 11' are mounted. Each of these plates is provided with a (preferably centrally arranged) passage 13 communicating with the respective hollow 12'. The number and circumferential distribution of the hollows 12' may correspond to that shown for the recesses and plates 11 in FIG. 2. Suitable channels (not illustrated) are provided via which the hollows 12' are filled (e.g., via the shaft 6) with oil from the sump 19.

The operation of the embodiment in FIG. 5 is identical with that in FIGS. 2–4, insofar as the plates 11 are concerned. In addition, however, the oil in the hollows 12' flows—during operation of the compressor—through the passages 13' and lubricates the areas of contact between the plates 11' and the covers 2, 2'.

Although in the embodiment of FIGS. 2–4 plates 11, 11' are flush with the endfaces 3*a*, it will be understood from FIG. 5 that in special cases they can be made to project from these endfaces (in all embodiments) by a small amount (e.g., about 0.002 mm) while still at room temperature, as shown with reference to the faces 3*a'* in FIG. 5. The operation will not be changed thereby.

It is also possible for the plates 11, 11' to have a different configuration than that shown in the drawings.

While the invention has been illustrated and described as embodied in a sliding vane compressor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fiarly constitute essential characteristics of the generic or specific aspects of this invention.

What is claimed as new and desired to be protected by Letters Patent is set forth in the appended claims.

1. In a sliding vane compressor of the type having a housing and a rotor journalled for rotation in a chamber of the housing so that the axial endfaces of the rotor are juxtaposed with slight clearance relative to the cooperating housing surfaces, a combination comprising means bounding a plurality of recess in each axial end face of the rotor; and an insert received in each of said recesses and being of a material having a relatively low coefficient of friction and having a coefficient of thermal expansion which is higher than that of the material of the rotor so that, upon reaching a predetermined temperature, said inserts expand and extend across the respective clearance into contact with said housing surfaces to prevent direct contact between the same and said axial endfaces of the rotor, said inserts having outer faces exposed at said axial end faces and being flush with the same at temperatures below said predetermined temperature.

2. A combination as defined in claim 1, wherein said material of said inserts is aluminum.

3. A combination as defined in claim 1, said inserts being plate-shaped.

4. A combination as defined in claim 1, wherein said predetermined temperature is the operating temperature of the compressor.

5. A combination as defined in claim 1, said recesses being hollows extending in said rotor, and said inserts each having at least one passage communicating with the respective hollow so that oil admitted into said hollows can circulate through said passages out of said hollows.

6. A combination as defined in claim 5, said one passage being provided centrally in the respective insert.

7. A combination as defined in claim 5, said outer exposed faces of said inserts project slightly outwardly beyond the respective axial endface prior to said rotor reaching said predetermined temperatures.

8. A combination as defined in claim 7, wherein said faces project beyond said axial endfaces by about 0.002 mm.

9. A combination as defined in claim 1, said inserts having exposed outer faces which, when said rotor is at said predetermined temperature, project beyond said axial endfaces by a distance of up to about 0.1 mm.

10. A combination as defined in claim 9, wherein said faces project by between 0.002 mm and 0.03 mm.

* * * * *